US009755313B2

(12) United States Patent
Park et al.

(10) Patent No.: US 9,755,313 B2
(45) Date of Patent: Sep. 5, 2017

(54) CHIP ANTENNA FOR NEAR FIELD COMMUNICATION AND METHOD OF MANUFACTURING THE SAME

(71) Applicants: SAMSUNG ELECTRONICS CO., LTD., Suwon-si (KR); KOREA ADVANCED INSTITUTE OF SCIENCE AND TECHNOLOGY, Daejeon (KR)

(72) Inventors: Chulsoon Park, Daejeon (KR); Hojung Kim, Suwon-si (KR); Hongyi Kim, Daejeon (KR); Innyeal Oh, Daejeon (KR); Joongho Lee, Daejeon (KR); Taehwan Jang, Daejeon (KR)

(73) Assignees: SAMSUNG ELECTRONICS CO., LTD., Suwon-si (KR); KOREA ADVANCED INSTITUTE OF SCIENCE AND TECHNOLOGY, Daejeon-si (KR)

( * ) Notice: Subject to any disclaimer, the term of this patent is extended or adjusted under 35 U.S.C. 154(b) by 91 days.

(21) Appl. No.: 14/830,335

(22) Filed: Aug. 19, 2015

(65) Prior Publication Data

US 2016/0118721 A1 Apr. 28, 2016

(30) Foreign Application Priority Data

Oct. 23, 2014 (KR) ..... 10-2014-0144286

(51) Int. Cl.
*H01Q 1/38* (2006.01)
*H01Q 9/28* (2006.01)
*H01Q 1/22* (2006.01)

(52) U.S. Cl.
CPC ..... *H01Q 9/28* (2013.01); *H01Q 1/2283* (2013.01)

(58) Field of Classification Search
CPC ..... H01Q 9/28; H01Q 1/2283; H01Q 1/24; H01Q 1/38
(Continued)

(56) References Cited

U.S. PATENT DOCUMENTS 2,290,314 A * 7/1942 Carter ..... H01Q 11/06 343/734
4,335,385 A * 6/1982 Hall ..... H01Q 11/04 343/700 MS
(Continued)

FOREIGN PATENT DOCUMENTS

GB 1529361 A * 10/1978 ..... H01Q 1/38
JP 2013-192073 A 9/2013
(Continued)

OTHER PUBLICATIONS

Chen, et al.; "V-Band On-Chip Dipole-Based Antenna", IEEE Transactions on Antennas and Propagation, Oct. 2009, vol. 57, No. 10, 9 pages total.
(Continued)

*Primary Examiner* — Tho G Phan
(74) *Attorney, Agent, or Firm* — Sughrue Mion, PLLC

(57) ABSTRACT

Provided are chip antennas for near field communication and methods of manufacturing the chip antennas. A chip antenna for near field communication includes a substrate; a first antenna element on the substrate; and a second antenna element on the first antenna element. The substrate, the first antenna element, and the second antenna element are included in a single chip. The first and second antenna elements are formed outside the chip. The substrate is a lower layer including a plurality of devices. The first antenna element is a metal structure having a fish bone shape. The second antenna element is a dipole antenna.

14 Claims, 7 Drawing Sheets

(58) Field of Classification Search
USPC ..... 343/700 MS, 702, 829, 846, 794, 795
See application file for complete search history.

(56) References Cited

U.S. PATENT DOCUMENTS

| | | | | |
|---|---|---|---|---|
| 8,059,041 | B2 * | 11/2011 | Chang | H01Q 1/42 343/702 |
| 8,665,163 | B2 * | 3/2014 | Apostolos | H01Q 1/3291 343/713 |
| 2010/0309087 | A1 * | 12/2010 | Tsai | H01Q 1/38 343/861 |
| 2013/0016013 | A1 * | 1/2013 | Wong | H01Q 1/243 343/700 MS |

FOREIGN PATENT DOCUMENTS

| | | | |
|---|---|---|---|
| KR | 10-2003-0060763 | A | 7/2003 |
| KR | 10-2008-0016353 | A | 2/2008 |
| KR | 10-2008-0051180 | A | 6/2008 |
| KR | 10-0883990 | B1 | 2/2009 |

OTHER PUBLICATIONS

Lee, et al.; "A Slow-Wave Microstrip Line With a High-Q and a High Dielectric Constant for Millimeter-Wave CMOS Application", IEEE Microwaves and Wireless Components Letters, Jul. 2010, vol. 20, No. 7, 3 pages total.

* cited by examiner

CHIP ANTENNA FOR NEAR FIELD COMMUNICATION AND METHOD OF MANUFACTURING THE SAME

CROSS-REFERENCE TO RELATED APPLICATION

This application claims priority from Korean Patent Application No. 10-2014-0144286, filed on Oct. 23, 2014 in the Korean Intellectual Property Office, the disclosure of which is incorporated herein in its entirety by reference.

BACKGROUND

1. Field

Apparatuses and methods consistent with exemplary embodiments relate to communication devices, and more particularly, to chip antennas for near field communication and methods of manufacturing the chip antennas.

2. Description of the Related Art

An antenna is one of the elements that constitute a radio frequency (RF) wireless communication system. Radiation efficiency and gain of the antenna may be important factors for evaluating the power efficiency of the RF wireless communication system. If radiation efficiency and gain of the antenna are high, a burden of a power amplifier that consumes large power may be reduced in an RF wireless communication system and power efficiency of the RF wireless communication system may be increased, which means that the time for using an RF wireless communication system that uses a battery can be increased.

Therefore, an antenna may be manufactured by using a high performance substrate such as a Duroid substrate, a TLY substrate, or a low temperature co-fired ceramic (LTCC) substrate. However, in the case of an off-chip antenna, generally, the antenna has a larger size than the off chip. Also, when, as in a power amplifier, an antenna is connected to an end point of an RF portion by wire bonding or flip-chip bonding, impedance matching is required. Also, in this process, even though the antenna itself has a broadband characteristic, a bandwidth limitation may occur in the whole system. Therefore, by taking into account the cost for separately manufacturing the antenna and the additional cost for connecting the chip to the antenna, the off-chip antenna is not suitable for communicating between chips.

However, an on-chip antenna uses a metal line process that is provided for connection between elements in a silicon process and uses the same a manufacturing process as other RF circuits. Accordingly, in the case of the on-chip antenna, an additional cost is not incurred for manufacturing the on-chip antenna, and thus, the costs for manufacturing a whole system may be reduced. Also, due to the high dielectric constant of silicon, the size of the on-chip antenna may be reduced. However, power loss due to the high resistance and high dielectric constant of silicon, radiation efficiency and gain of the on-chip antenna may be reduced.

In the case of a general dipole antenna, it is difficult to apply the general dipole antenna to a system that requires a broadband characteristic due to the narrow band width of the general dipole antenna.

SUMMARY

Exemplary embodiments address at least the above problems and/or disadvantages and other disadvantages not described above. Also, the exemplary embodiments are not required to overcome the disadvantages described above, and may not overcome any of the problems described above.

One or more exemplary embodiments are chip antennas for near field communication that maximize bandwidth and antenna efficiency by reducing power loss and may be used for miniaturization.

Still, one or more exemplary embodiments are methods of manufacturing the chip antennas for near field communication.

According to an aspect of an exemplary embodiment, there is provided a chip antenna for near field communication including: a substrate; a first antenna element that has a fish bone structure and is disposed on the substrate; and a second antenna element disposed on the first antenna element.

The substrate, the first antenna element, and the second antenna element may be included in a single chip.

The first and second antenna elements may be formed on an external surface of the chip.

The substrate may be a lower layer including a plurality of devices.

The first antenna element may be covered by an insulating layer, and the second antenna element is formed on the insulating layer.

The second antenna element is a dipole antenna.

The first antenna element may include: a first metal wire; a plurality of second metal wires attached to a side surface of the first metal wire; and a plurality of third metal wires attached to the other side surface of the first metal wire, wherein the second and third metal wires are perpendicular to a length direction of the first metal wire.

The first antenna element may include: a backbone wire; a plurality of left-side rib wires that extend from the backbone wire; and a plurality of right-side rib wires that extend from the backbone wire in a direction opposite to the plurality of left-side rib wires.

A capacitance of the first antenna element may be controlled by a distance between two adjacent ones of the plurality of left-side rib wires.

According to another aspect of an exemplary embodiment, there is provided a method of manufacturing a near field communication chip antenna, the method including: forming a first antenna element on a substrate to have a fish bone structure; forming an insulating layer covering the first antenna element on the substrate; and forming a second antenna element on the insulating layer.

The substrate may be formed of silicon.

The substrate may include a plurality of devices.

The forming the first antenna element may include: forming a metal layer on the substrate; and forming the fish bone structure by patterning the metal layer.

The second antenna element may be a dipole antenna.

The forming the first antenna element may include: forming a first metal wire; forming a plurality of second metal wires attached to a side surface of the first metal wire; and forming a plurality of third metal wires attached to the other side surface of the first metal wire, wherein the second and third metal wires are perpendicular to a length direction of the first metal wire.

BRIEF DESCRIPTION OF THE DRAWINGS

The above and/or other aspects will be more apparent by describing certain exemplary embodiments, with reference to the accompanying drawings, in which.

DETAILED DESCRIPTION

Figure 1:
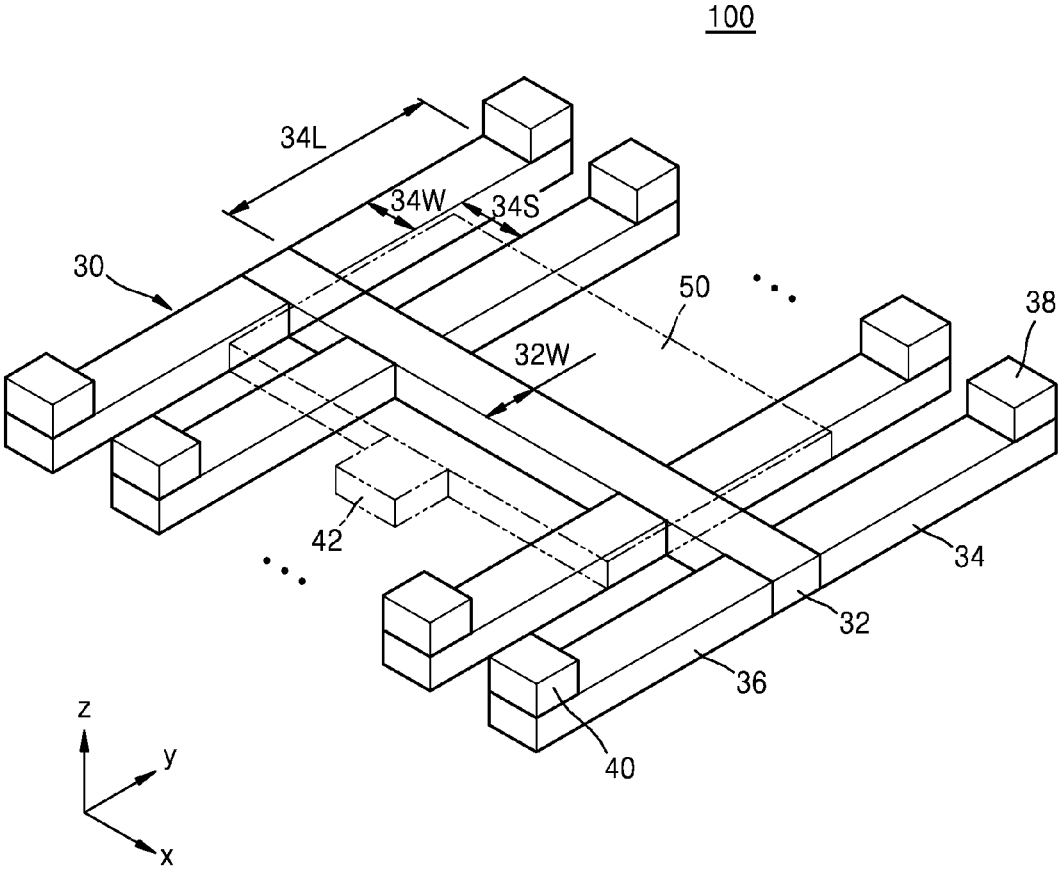
FIG. 1 is a perspective view of a chip antenna for near field communication according to an exemplary embodiment.

Exemplary embodiments are described in greater detail below with reference to the accompanying drawings.

In the following description, like drawing reference numerals are used for like elements, even in different drawings. The matters defined in the description, such as detailed construction and elements, are provided to assist in a comprehensive understanding of the exemplary embodiments. However, it is apparent that the exemplary embodiments can be practiced without those specifically defined matters. Also, well-known functions or constructions are not described in detail since they would obscure the description with unnecessary detail.

FIG. 1 is a perspective view of a chip antenna 100 for near field communication (hereinafter, referred to as 'a chip antenna 100') according to an exemplary embodiment.

Referring to FIG. 1, the chip antenna 100 includes a first antenna element 30 and a second antenna element 50. The second antenna element 50 may be formed on the first antenna element 30. The second antenna element 50 may be, for example, a dipole antenna. The second antenna element 50 has a connection terminal 42 that is connected to a power amplifier. Power is supplied from the power amplifier through the connection terminal 42. The first antenna element 30 may be a metal structure having a fish bone shape. As the first antenna element 30 is provided in the chip antenna 100, capacitance and inductance may be added to the chip antenna 100 than when only the second antenna element 50 is present in the chip antenna 100. Accordingly, a low-velocity wave structure is formed in the chip antenna 100, and as a result, a total physical size of the chip antenna 100 may be reduced. In this way, a phase velocity of the chip antenna 100 is reduced, and an effective wavelength of the chip antenna 100 may also be reduced. Therefore, the size of the chip antenna 100 may be substantially reduced. As components of capacitance and inductance are additionally increased by the presence of the first antenna element 30, many resonance points may be generated in the chip antenna 100. As a result, a bandwidth of the chip antenna 100 may be increased.

A total width in the y-axis and x-axis directions of the second antenna element 50 may be less than a total width in the y-axis and x-axis directions of the first antenna element 30. The second antenna element 50 may be disposed between first and second contact pads 38 and 40 of the first antenna element 30 in the y-axis direction.

Figure 2:
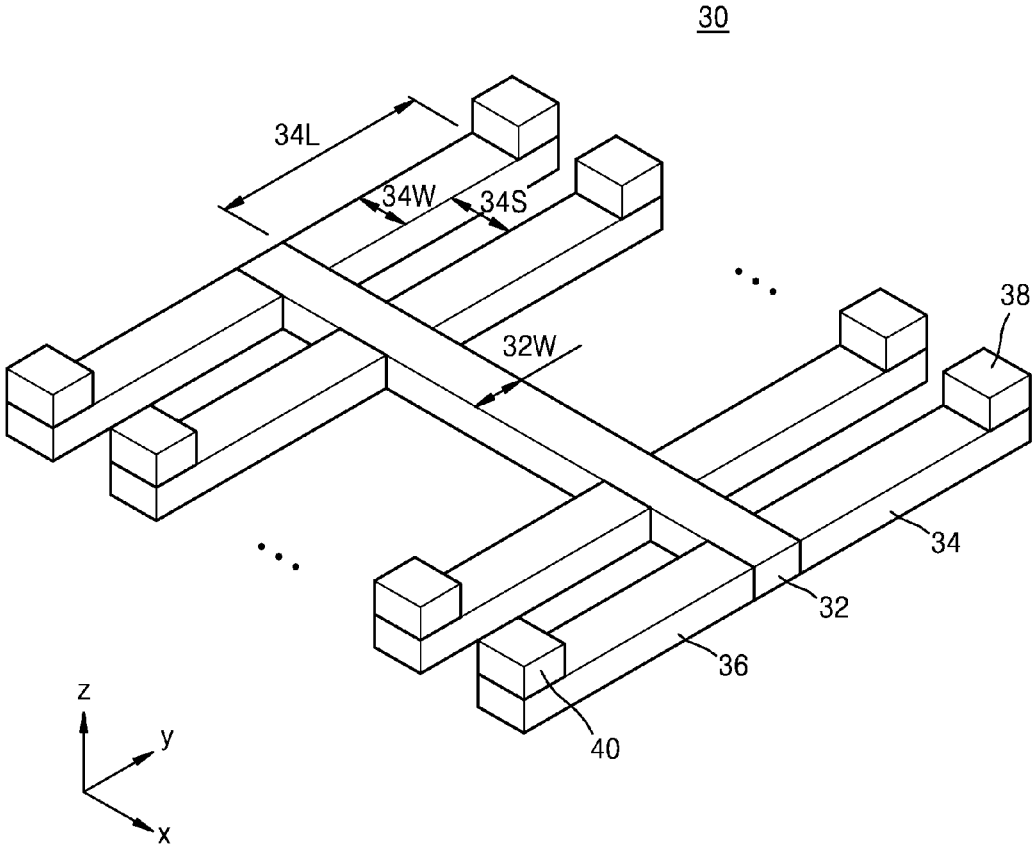
FIG. 2 is a perspective view of a first antenna element of FIG. 1.

FIG. 2 is a perspective view of the first antenna element 30 of FIG. 1.

Referring to FIG. 2, the first antenna element 30 includes a first metal wire 32 that corresponds to a backbone of a fish bone, a plurality of second metal wires (also referred to as right-side rib wires) 34 that are connected to a side (a side surface) of the first metal wire 32, and a plurality of third metal wires (also referred to as left-side rib wires) 36 that are connected to other side (the other side surface) of the first metal wire 32. The number of second and third metal wires 34 and 36 may be determined according to a design condition of the chip antenna 100. The second and third metal wires 34 and 36 correspond to bones attached to both sides of a backbone of a fish bone structure. The second and third metal wires 34 and 36 may be disposed perpendicular to a length direction of the first metal wire 32. An angle between the first metal wire 32 and the second and third metal wires 34 and 36 may be less or more than 90°. A length 34L of the second metal wire 34 in the y-axis direction may be less than a length of the first metal wire 32 in the x-axis direction. A length of the third metal wire 36 in a y-axis direction may be equal to the length 34L of the second metal wires 34 in the y-axis direction. However, the lengths of the second and third metal wires 34 and 36 may vary. For example, the length of the third metal wire 36 in the y-axis direction may be greater or less than the length 34L of the second metal wire 34 in the in the y-axis direction. The second and third metal wires 34 and 36 may face each other with the first metal wire 32 therebetween. The second metal wires 34 may respectively correspond to the third metal wires 36. The first metal wire 32 has a first width 32W in the y-axis direction. The second metal wires 34 have a second width 34W in the x-axis direction. The first width 32W and the second width 34W may be equal or different. The third metal wires 36 may have the same width as or a different width from the second width 34W of the second metal wires 34.

The second metal wires 34 are arranged in the x-axis direction with a first gap 34S. The third metal wires 36 may also be arranged in the x-axis direction with the same gap as that of the second metal wires 34, or may be arranged with a gap different from that of the second metal wires 34.

The first and second widths 32W and 34W and the gap (space) 34S of the first, second, and third metal wires 32, 34, and 36 may be controlled, and accordingly, a bandwidth of the chip antenna 100 may be controlled. For example, a bandwidth of 21% may be obtained with respect to a central frequency. Also, gain of the chip antenna 100 may rise to 0 dB, and the efficiency of the chip antenna 100 may be increased more than 5%.

A first metal pad 38 for contact is formed on an edge of each of the second metal wires 34. A second metal pad 40 for contact may also be formed on an edge of each of the third metal wires 36.

Characteristics of the first antenna element 30 may be controlled and determined by at least one of the following variables: a number of the second metal wires 34, a number of the third metal wires 36, a length of the first metal wire 32, the first width 32W of the first metal wire 32, the second width 34W of the second metal wires 34, a distance 34S between two adjacent second metal wires 34 or two adjacent third metal wires 36, and the length 34L of the second metal wires 34.

For example, a capacitance of the first antenna element 30 is controlled by the distance 34S between two adjacent ones of the plurality of second metal wires 34.

Figure 3:
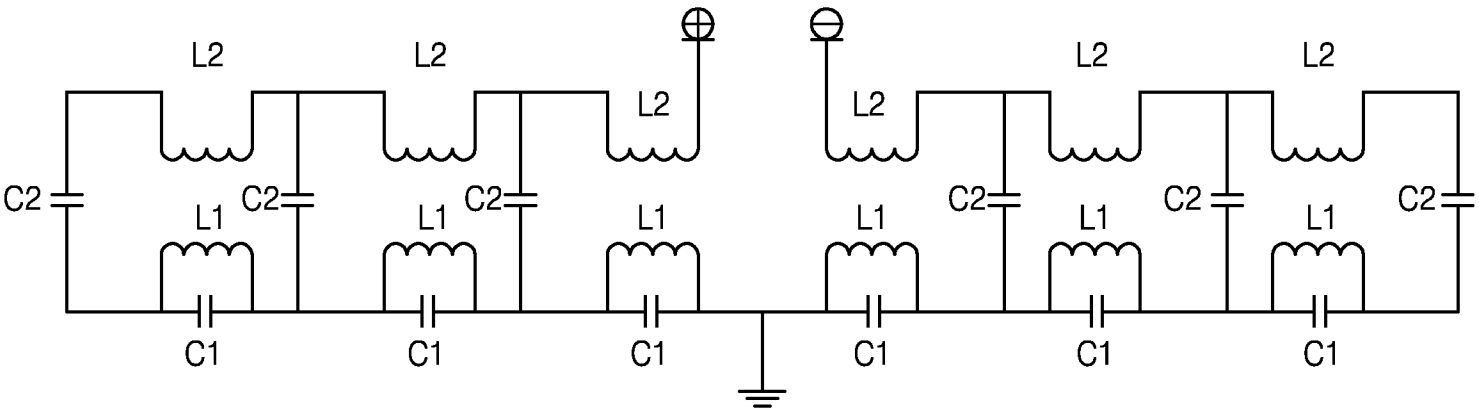
FIG. 3 is an equivalent circuit of the first antenna element of FIG. 2.

FIG. 3 is an equivalent circuit of the first antenna element 30 of FIG. 2.

In FIG. 3, a first capacitance C1 is a capacitance of a capacitor that includes two adjacent second metal wires 34 and an insulating material between the two adjacent second metal wires 34 or a capacitor that includes two adjacent third metal wires 36 and an insulating material between the two adjacent third metal wires 36. A second capacitance C2 is a capacitance of a capacitor that includes the first antenna element 30, the second antenna element 50, and an insulating material between the first and second antenna elements 30 and 50.

A first inductance L1 is an inductance by the second metal wires 34 or the third metal wires 36, and a second inductance L2 is an inductance of the first antenna element 30.

Since the first antenna element 30 is included in the chip antenna 100, as the additional capacitance and inductance of the chip antenna 100 are increased, a bandwidth of the chip antenna 100 is increased, and thus, miniaturization of the chip antenna 100 is possible.

Figure 4:
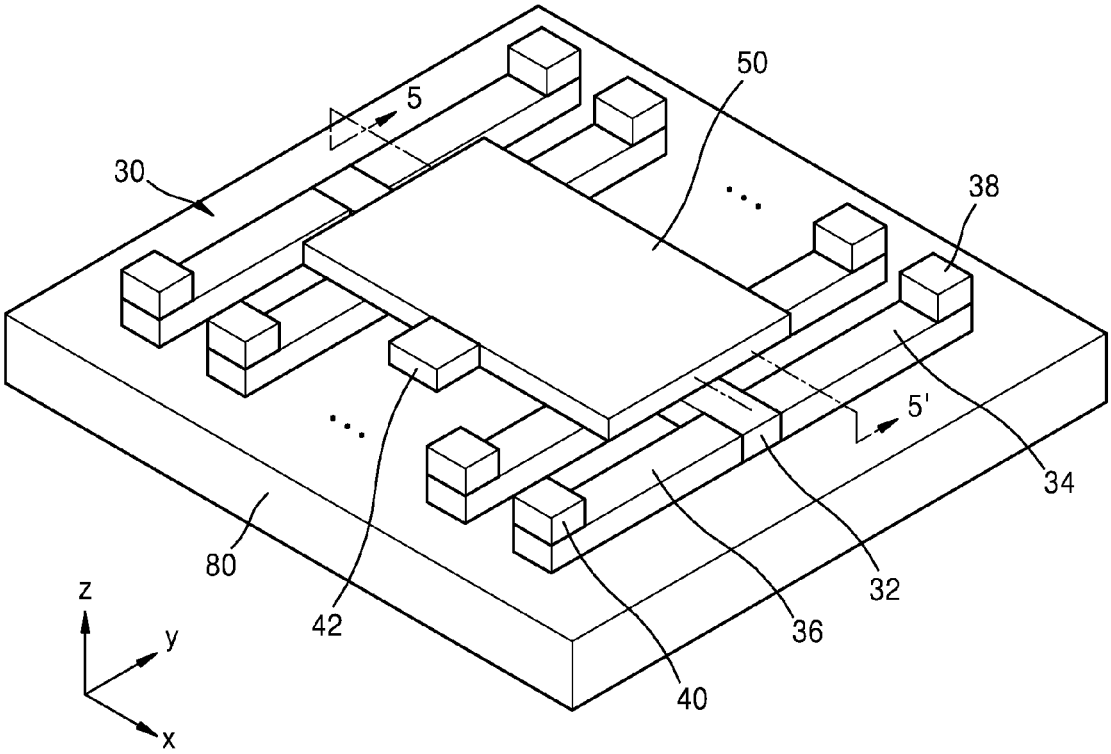
FIG. 4 is a perspective view showing a case that chip antenna for the near field communication of FIG. 1 is disposed on a substrate.

FIG. 4 is a perspective view showing a case that the chip antenna 100 of FIG. 1 is disposed on a substrate 80.

The first antenna element 30 has a floating metal structure with a fish bone shape and is disposed between the substrate 80 and the second antenna element 50. Since the first antenna element 30 is disposed in this manner, it may be prevented that an electromagnetic wave radiated from the second antenna element 50 is penetrated into the substrate 80. Accordingly, the efficiency of the chip antenna 100 may be increased, and thus, gain of the chip antenna 100 may also be increased.

Figure 5:
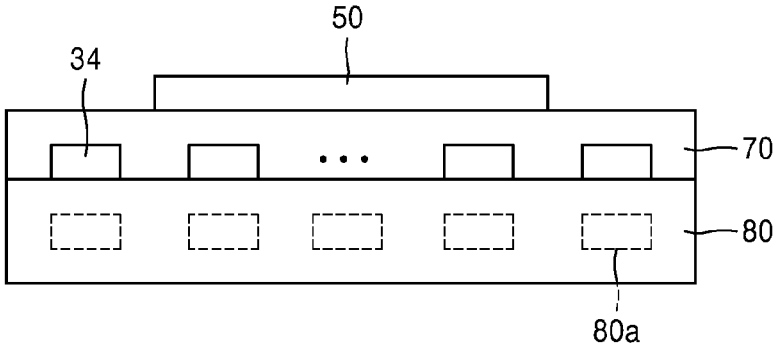
FIG. 5 is a cross-sectional view taken along line 5-5' of FIG. 4.

FIG. 5 is a cross-sectional view taken along line 5-5' of FIG. 4.

Referring to FIG. 5, the second metal wires 34 of the first antenna element 30 are formed on the substrate 80. The second metal wires 34 are covered by an insulating layer 70. The second antenna element 50 is formed on the insulating layer 70. The substrate 80 may be a silicon substrate which is placed underneath the insulating layer 70 and includes a plurality of devices 80*a*. The devices 80*a* may be general devices that are related to data communication through the chip antenna 100. Besides the devices 80*a*, the substrate 80 may further include other devices.

The chip antenna 100 is formed in a chip, but may be formed outside the chip.

Figure 6:
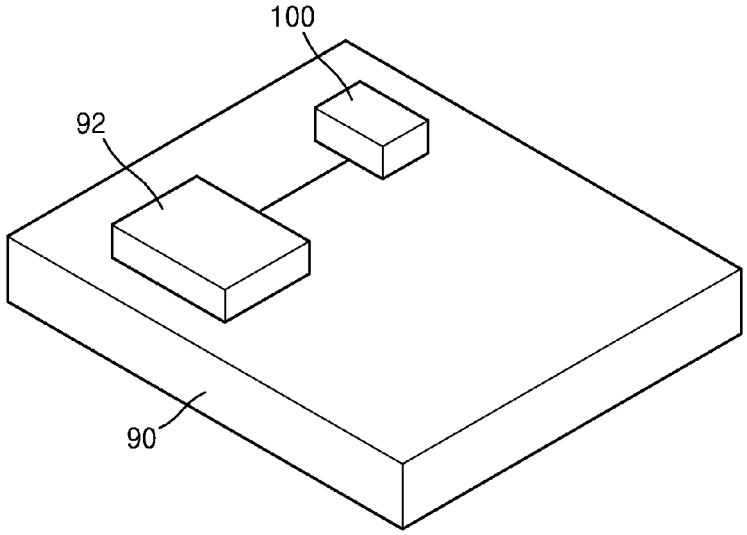
FIG. 6 is a perspective view showing a case that a chip antenna for near field communication according to an exemplary embodiment is provided outside a chip.

For example, referring to FIG. 6, a chip 92 and the chip antenna 100 are formed on a substrate 90. The chip 92 may be a chip related to wireless communication. The chip 92 and the chip antenna 100 are separate from each other. The chip 92 and the chip antenna 100 are connected by a wire.

Figure 7:
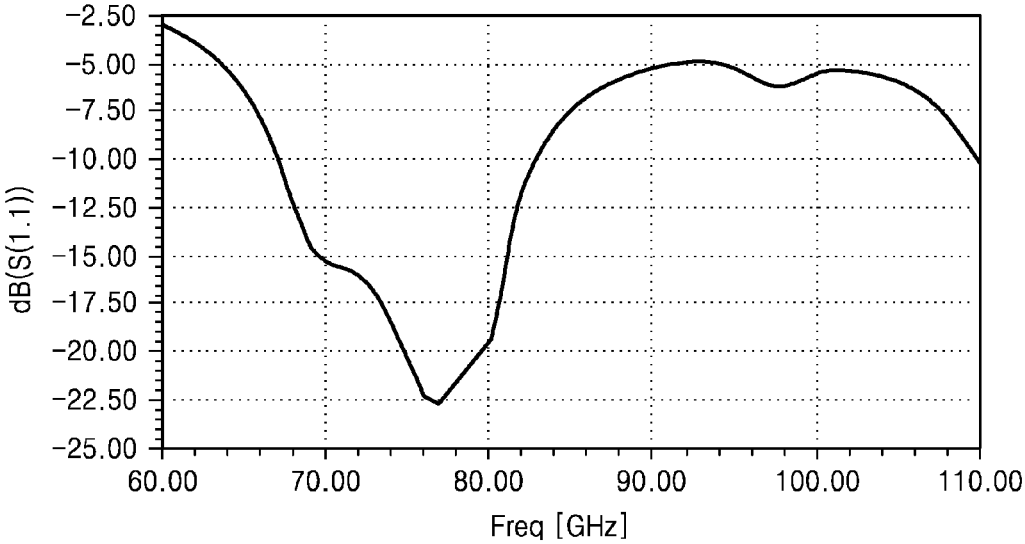
FIG. 7 is a graph showing a simulation result of insertion loss of a chip antenna for near field communication according to an exemplary embodiment.

FIG. 7 is a graph showing a simulation result of insertion loss as an operation characteristic of the chip antenna 100, according to an exemplary embodiment.

Referring to FIG. 7, it is seen that the frequency width below −10 dB satisfies a bandwidth range from 67 GHz to 83 GHz.

Figure 8:
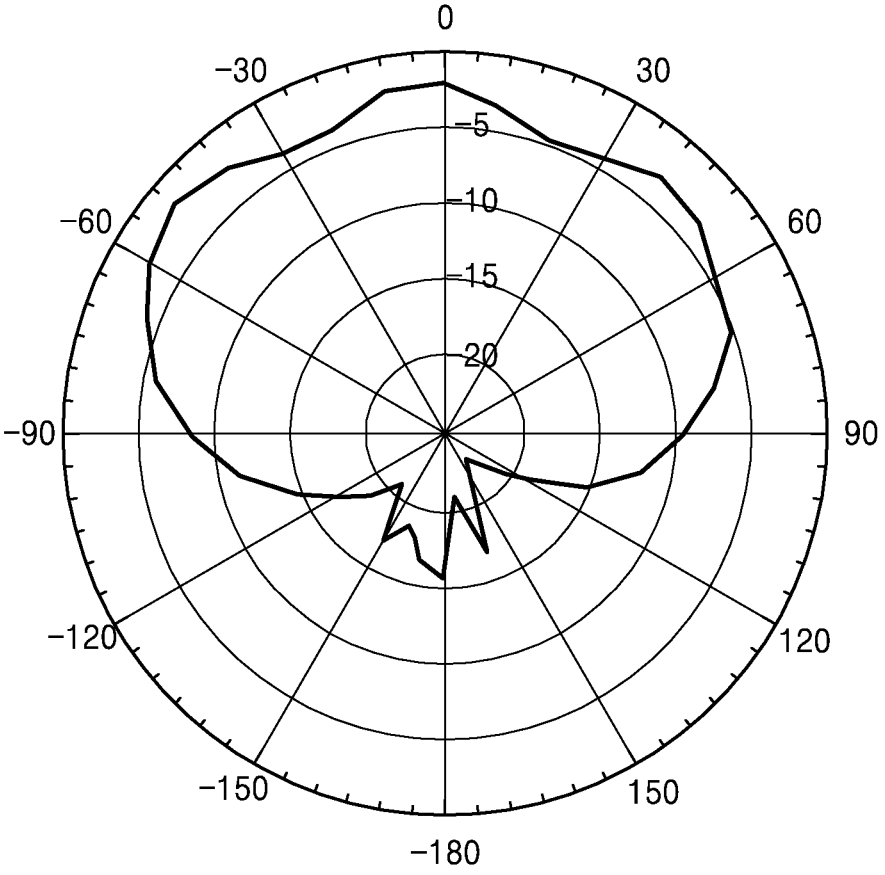
FIG. 8 is a graph showing a simulation result of a beam pattern on an E-plane of a chip antenna for near field communication according to an exemplary embodiment.

FIG. 8 is a graph showing a simulation result of a beam pattern on an E-plane as an operation characteristic of the chip antenna 100 according to an exemplary embodiment.

Figure 9:
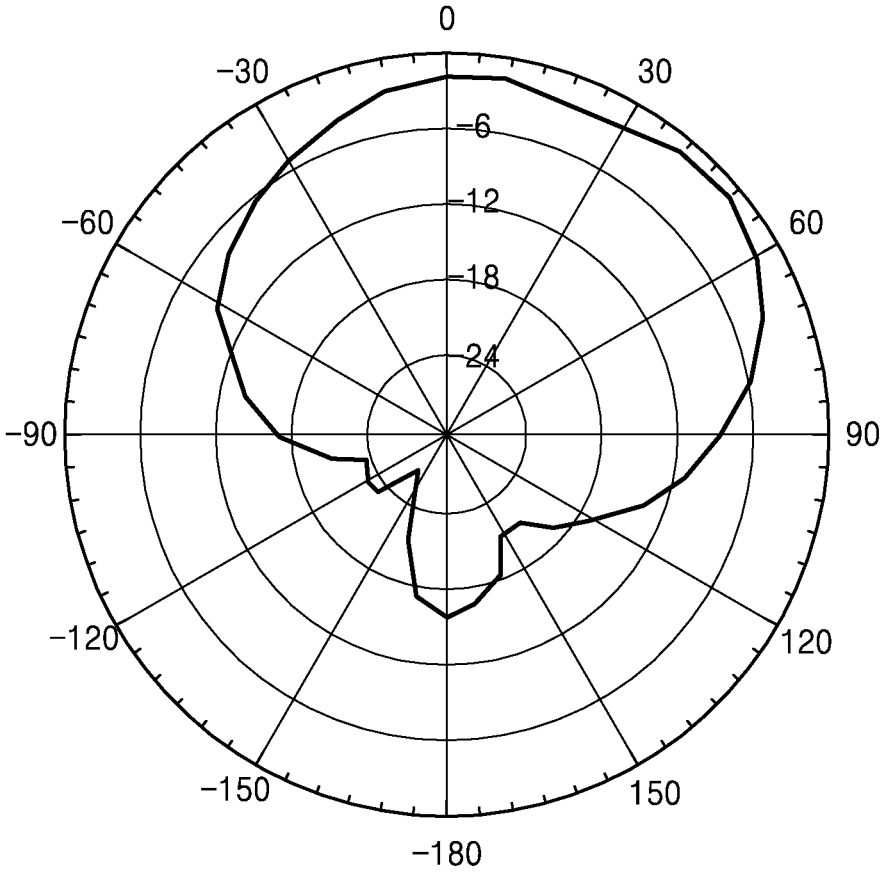
FIG. 9 is a graph showing a simulation result of a beam pattern on an H-plane of a chip antenna for near field communication according to an exemplary embodiment.

FIG. 9 is a graph showing a simulation result of a beam pattern on an H-plane of the chip antenna 100 according to an exemplary embodiment.

Referring to FIGS. 8 and 9, it is seen that gain of the chip antenna 100 satisfies −1 dB.

A method of manufacturing the chip antenna 100 will be described with reference to FIGS. 4 and 5.

First, a first antenna element 30 is formed on a substrate 80. The first antenna element 30 may be formed such that, after forming a metal layer, for example, an Al layer or a Cu layer on the substrate 80, a metal structure having a fish bone shape may be formed by patterning the metal layer by using a photo and etching process. The metal structure having a fish bone shape may be the same as the metal structure described with reference to FIG. 2.

Next, as depicted in FIG. 5, an insulating layer 70 covering the first antenna element 30 is formed on the substrate 80. The insulating layer 70 may be, for example, silicon oxide. A second antenna element 50 is formed on the insulating layer 70. The second antenna element 50 may also be formed by patterning a metal layer, after forming the metal layer in the same manner as the first antenna element 30. At this point, the metal layer may also be patterned so that a connection terminal 42 and first and second metal pads 38 and 40 are formed together with the second antenna element 50.

The chip antenna 100 is a wide band antenna and includes a floating metal structure having a fish bone shape under a dipole antenna. Accordingly, capacitance is added between the dipole antenna and the fish bone structure and inductance by the fish bone structure is added, and thus, a low velocity structure is formed. As a result, a physical size of the whole chip antenna may be reduced. Also, a phase velocity and effective wavelength of the chip antenna may be reduced, and thus, the size of the chip antenna may be practically reduced.

Also, due to the added capacitance and inductance components, many resonance points may be generated in the chip antenna. As a result, a bandwidth of the chip antenna may be increased.

Since the fish bone structure is provided, the penetration of an electromagnetic wave into the silicon substrate is prevented, and as a result, radiation efficiency and gain of the chip antenna may be increased.

A bandwidth of the chip antenna may be widened by controlling widths and gaps of elements (metal wires) that constitute the fish bone structure. Therefore, a bandwidth of 21% with respect to a central frequency may be obtained, gain of the antenna may rise to 0 dB, and efficiency may increase by more than 5%.

The chip antenna described above has a wide bandwidth characteristic and is small in size, and thus, may be used for chip-to-chip wireless communication having high speed transmission and high efficiency characteristics. Also, since the chip antenna can be included in a chip, the chip antenna may be applied to data transmission, such as mobile communication devices, memories, access points (APs), displays, etc.

The foregoing exemplary embodiments are merely exemplary and are not to be construed as limiting. The present teaching can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. A chip antenna for near field communication, the chip antenna comprising:

a substrate;

a first antenna element that has a fish bone structure and is disposed on the substrate; and a second antenna element disposed on the first antenna element, wherein the first antenna element comprises a first metal wire, a plurality of second metal wires attached to a side surface of the first metal wire, and a plurality of third metal wires attached to the other side surface of the first metal wire, and wherein the second and third metal wires are perpendicular to a length direction of the first metal wire.

2. The chip antenna of claim 1, wherein the substrate, the first antenna element, and the second antenna element are included in a single chip.

3. The chip antenna of claim 1, wherein the first and second antenna elements are formed on an external surface of the chip.

4. The chip antenna of claim 1, wherein the substrate is a lower layer including a plurality of devices.

5. The chip antenna of claim 1, wherein the first antenna element is covered by an insulating layer, and the second antenna element is formed on the insulating layer.

6. The chip antenna of claim 1, wherein the second antenna element is a dipole antenna.

7. A chip antenna for near field communication, the chip antenna comprising:

a substrate;

a first antenna element that is disposed on the substrate and comprises:

a backbone wire;

a plurality of left-side rib wires that extend from the backbone wire;

a plurality of right-side rib wires that extend from the backbone wire in a direction opposite to the plurality of left-side rib wires;

a plurality of first metal pads respectively disposed on edges of the plurality of left-side rib wires; and a plurality of second metal pads respectively disposed on edges of the plurality of right-side rib wires; and a second antenna element that is disposed on the first antenna element.

8. The chip antenna of claim 7, wherein a capacitance of the first antenna element is controlled by a distance between two adjacent ones of the plurality of left-side rib wires.

9. The chip antenna of claim 7, wherein a length of the second antenna element is shorter than a length of the backbone wire, and a width of the second antenna element is shorter than a sum of a width of the backbone wire, a width of the left-side rib wires, and a width of the right-side rib wires so that an entire portion of the second antenna element is disposed on the first antenna element.

10. A method of manufacturing a near field communication chip antenna, the method comprising:

forming a first antenna element on a substrate to have a fish bone structure;

forming an insulating layer covering the first antenna element on the substrate; and forming a second antenna element on the insulating layer, wherein the forming the first antenna element comprises forming a first metal wire, forming a plurality of second metal wires attached to a side surface of the first metal wire, and forming a plurality of third metal wires attached to the other side surface of the first metal wire, and wherein the second and third metal wires are perpendicular to a length direction of the first metal wire.

11. The method of claim 10, wherein the substrate is formed of silicon.

12. The method of claim 10, wherein the substrate includes a plurality of devices.

13. The method of claim 10, wherein the forming the first antenna element includes:

forming a metal layer on the substrate; and forming the fish bone structure by patterning the metal layer.

14. The method of claim 10, wherein the second antenna element is a dipole antenna.

* * * * *